US008850643B2

(12) United States Patent
White

(10) Patent No.: US 8,850,643 B2
(45) Date of Patent: Oct. 7, 2014

(54) AROMATIC AIR EFFUSION APPARATUS FOR A PILLOW

(71) Applicant: Chester Lewis White, New York, NY (US)

(72) Inventor: Chester Lewis White, New York, NY (US)

( * ) Notice: Subject to any disclaimer, the term of this patent is extended or adjusted under 35 U.S.C. 154(b) by 0 days.

(21) Appl. No.: 13/769,284

(22) Filed: Feb. 16, 2013

(65) Prior Publication Data

US 2014/0053338 A1 Feb. 27, 2014

Related U.S. Application Data

(60) Provisional application No. 61/599,928, filed on Feb. 16, 2012.

(51) Int. Cl.
*A47G 9/10* (2006.01)
*A47G 9/00* (2006.01)

(52) U.S. Cl.
CPC ..... *A47G 9/1045* (2013.01); *A47G 9/007* (2013.01)
USPC ..... 5/641; 5/636

(58) Field of Classification Search
USPC ..... 5/641, 636, 630, 423, 652.2, 726
See application file for complete search history.

(56) References Cited

U.S. PATENT DOCUMENTS

| | | | | | |
|---|---|---|---|---|---|
| 813,731 | A * | 2/1906 | Murmans | 5/726 |
| 2,890,465 | A * | 6/1959 | Mira | 5/644 |
| 2,917,046 | A * | 12/1959 | Fairbanks | 128/202.18 |
| 4,826,479 | A * | 5/1989 | Burgin et al. | 604/23 |
| 4,969,869 | A * | 11/1990 | Burgin et al. | 604/23 |
| 5,819,347 | A * | 10/1998 | Masuda | 5/641 |
| 6,430,764 | B1 * | 8/2002 | Peters | 5/641 |
| 7,195,660 | B2 * | 3/2007 | Little et al. | 55/385.1 |
| 8,468,628 | B1 * | 6/2013 | Cheng | 5/641 |
| 2005/0229557 | A1 * | 10/2005 | Little et al. | 55/385.1 |
| 2014/0053338 | A1 * | 2/2014 | White | 5/641 |

* cited by examiner

*Primary Examiner* — Robert G Santos

(57) ABSTRACT

An aromatic air effusion apparatus for a pillow is introduced for both leisure relaxation and for retirement at night. This pillow apparatus is unique over conventional art providing a user with a great variety of options for mechanically controlled effusions of aromatic scents that are channeled throughout the interior of the pillow. A compression and timing apparatus effuses air through a scented permeable medium then conducts such air throughout the pillow whereby such treated air would be a source of a gratifying emotional experience for the user. According to practitioners of aromatherapy, and those who patronize the benefits of its products, the scents of both synthetic and natural plant extract oils, which would be used with this first, advanced-technology pillow, are personally and emotionally rewarding as they enhance both mood and even metabolism for overall well-being and improved health.

9 Claims, 4 Drawing Sheets

AROMATIC AIR EFFUSION APPARATUS FOR A PILLOW

CROSS-REFERENCE TO RELATED APPLICATION

This application references prior provisional No. 61/599,928 Filing Date: Feb. 16, 2012 for date of priority.

BACKGROUND

1. Field of the Invention

This invention relates to bed and leisure reclining pillows but more specifically to a pillow that can effuse aromatic scents of essential oils, which may be used as a commercial product for personal enhancement of both mood and metabolism.

2. Description of Related Prior Art

Pillows are generally of various sizes, shapes, degrees of softness, and design; primarily, they serve as conventional components of the dressings of beds as they generally provide a means for comfort in bed during times of retirement at night and at any other times for leisure. However, the present innovation provides a pillow with an additional benefit for comfort and retirement.

In the consumer market of aromatherapy, an extensive list of various aromatic scents is tied to a supposed evocation of a wide range of emotionally pleasurable mental experiences that a user would desire to bring to mind. According to aromatherapy practitioners, upon partaking of the essential oil scents of plant extracts, such experiences would return a user to either a remembered earlier period in one's life changing his or her mood or to a generally more elated and even exhilarating moment. This being the case, according to some research, the aromatic scents are therapeutic if used over a period of time. It is to this (aromatherapy) connection that the present invention is herein being related, as well as to the many varied, supposed, therapeutic usages being promoted in the commercial market. An aromatherapy pillow for an effusion of aromatic air (aromatherapy) for enhancing personal mood of a user of such pillow is herein presented.

This novel idea is a radical change from the traditional concept of the pillow in that the novel idea features a unique operation and active process for diffusing a user-selected, aromatic scent for the user from the interior of the pillow herein-presented whereby he, or she, can simultaneously benefit from both the usual physical headrest-comfort of a pillow as well as a specifically-selected, mechanically-controlled diffusion of an aromatic scent.

Preliminary prior art search has not uncovered any pillow that can provide the characteristics and benefits as does the novel art herein being presented. However, the only products uncovered that could be said to relate to the above effusion pillow are a bottled liquid scent, "Liquid Pillow," that may be sprinkled or sprayed onto a pillow and another whose interior is made of scented materials and whose scents a user of such pillow may breathe in but that, necessarily, become more ineffective with time since they are not designed in such way to inhibit volatility. No other "pillow" product duplicates, or is similar to, the novel Aromatic Air Effusion Pillow in its mechanical capability to cause compressed air to controllably effuse through an aromatically suffused porous medium to the interior of the pillow itself then to the diffusion points for transpiration to a user. Furthermore, it has the facility and benefit of a "direct" application of the above-stated aromatic scents and/or therapeutic vapors as with the Nasal Pin accoutrement component of this novel system.

SUMMARY

An improved pillow is presented which provides, in addition to a conventional means of a headrest during periods of relaxation and sleep, a means for conveying to a user aromatic air that has been initiated from its interior. Such aromatic air production is caused by, and sustained by, a mechanical device and conduit system that is designed to intake exterior air; compress it and effuse it through an essential oils, (or other relevant agent) porous medium; channel it throughout the pillow (diffusion); then cause it to transpire to a user of the pillow product for his/her desired effect. The effusion/diffusion device components, as a novel adaptation to a pillow for the effect of aromatic transpiration, (and direct inhalation—Nasal Clip component) to a user, are revolutionary to the consumer market for pillows.

Advantages

Some advantages of this novel product include the pleasure factors of the wide variety of pleasurable aromatic scents as gotten from hundreds of species of natural plant essential oils extracts and their evocative experiences which may serve as therapeutic aides for the user. According to aromatherapy theory, one's mood and overall outlook on life may be tremendously transformed. This novel pillow apparatus is easy to use. To operate it, simply wind the timer mechanism for the desired number of hours of operational time; it will compress the infused air as it quietly unwinds.

A fuller understanding of the nature and objects of the present invention will become apparent upon consideration of the detailed description below, taken in connection with the accompanying drawings.

BRIEF DESCRIPTIONS OF THE DRAWINGS

These and other features, aspects, and advantages of the invention will become better understood with regard to the following description, appended claims, and accompanying drawings where:

Figure 2A:
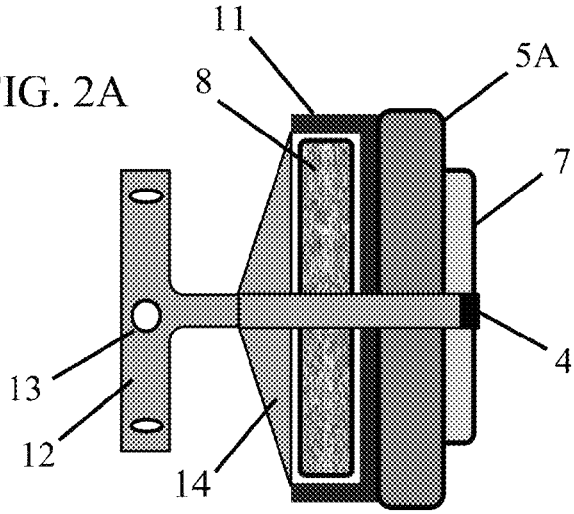
Figure 2B:
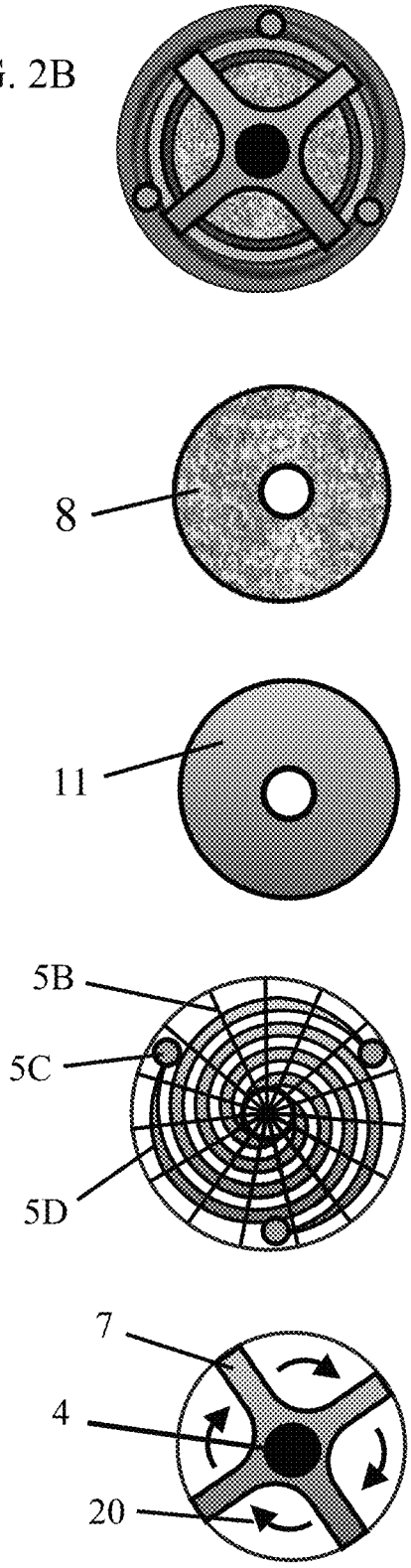

FIG. 2A cross sectional, cut-away, left side view of windup/control module for the pillow FIG. 2B is a top view of the windup/control module as identified in 2A.

Figure 3A:
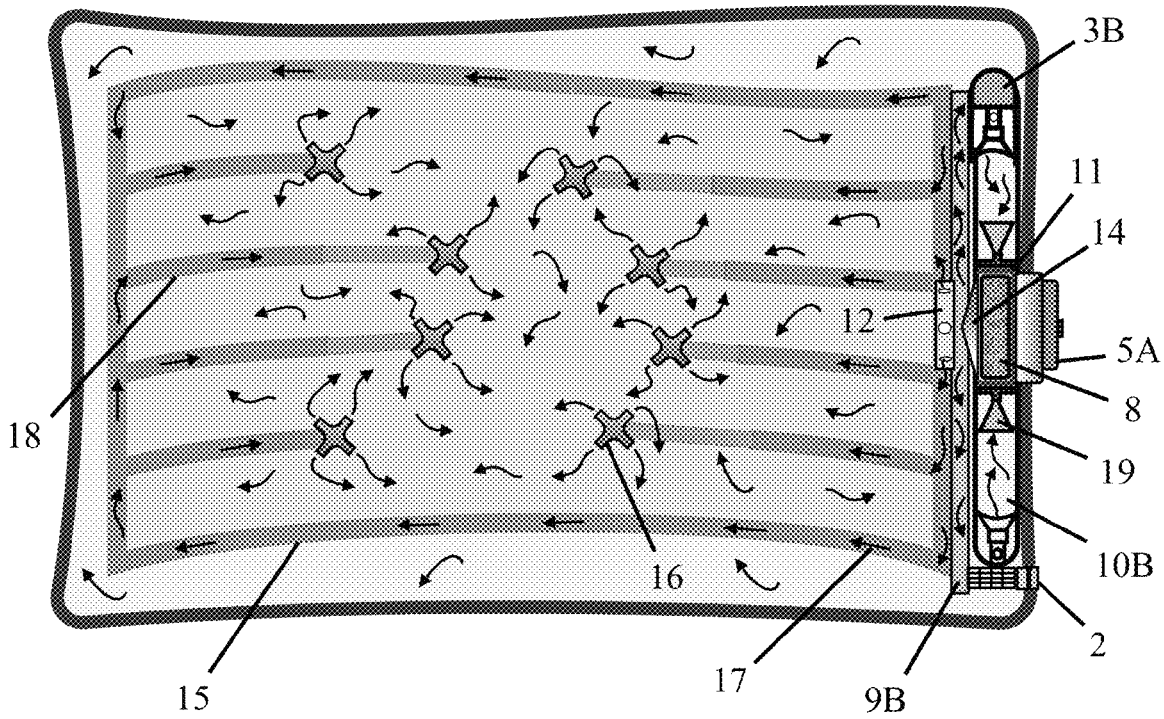
Figure 3A:
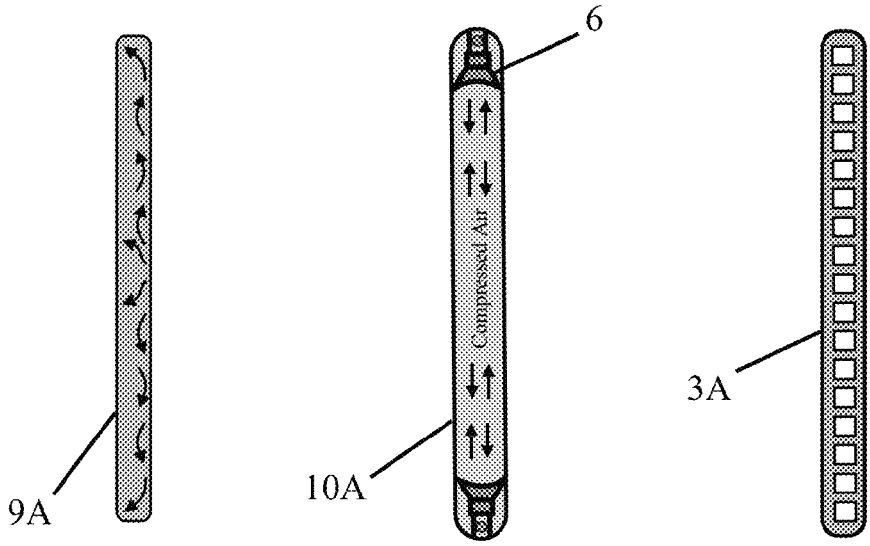

FIG. 3A is a Front Side upright view of interior structures of novel pillow with several sub-functional devices depicted below it.

Figure 3B:
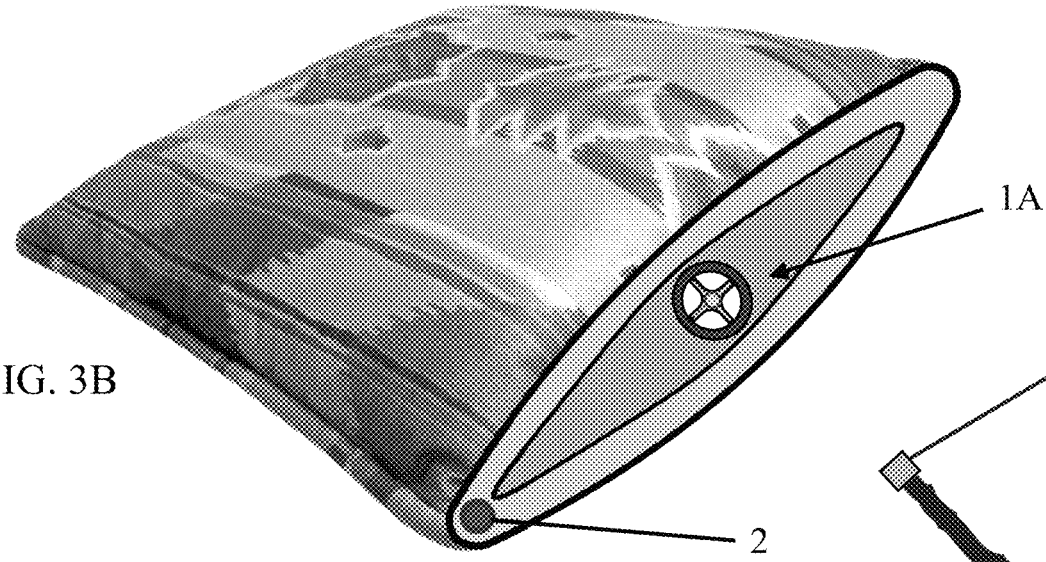

FIG. 3B is a perspective view depicting a conventional pillow showing how the novel apparatus would appear.

Figure 4:
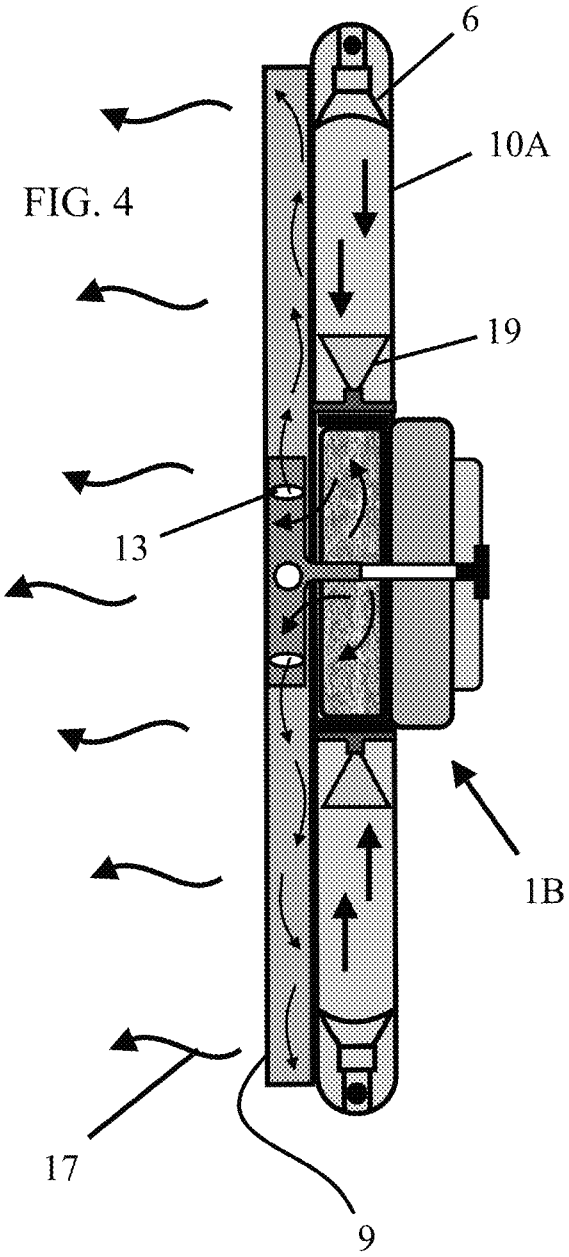

FIG. 4 These are side views of both the Compression Chamber Facility and the Transference Tube for conduction of the effusion of the aromatic air to the other parts of the pillow.

Figure 5:
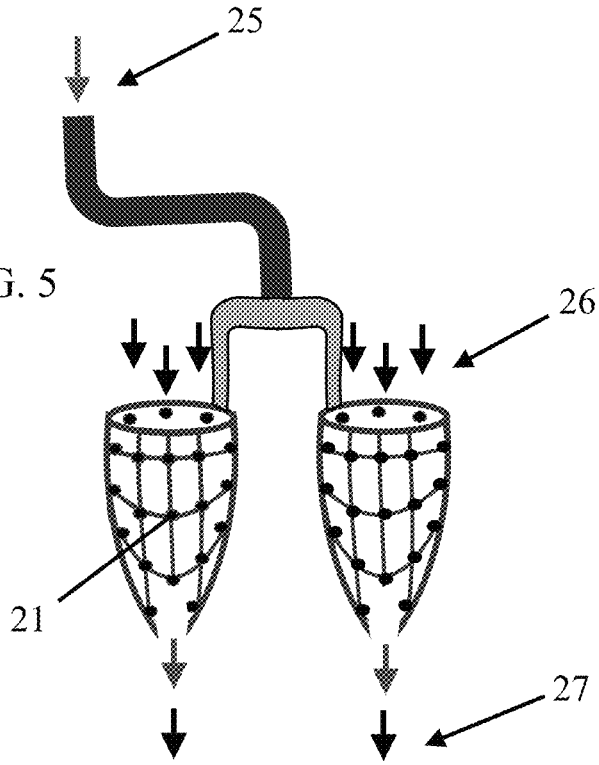

FIG. 5 depicts the distal end of the nasal insertion device's method of ingress of both environmental air and ingress of aromatic pressurized air from the pillow.

Figure 6:
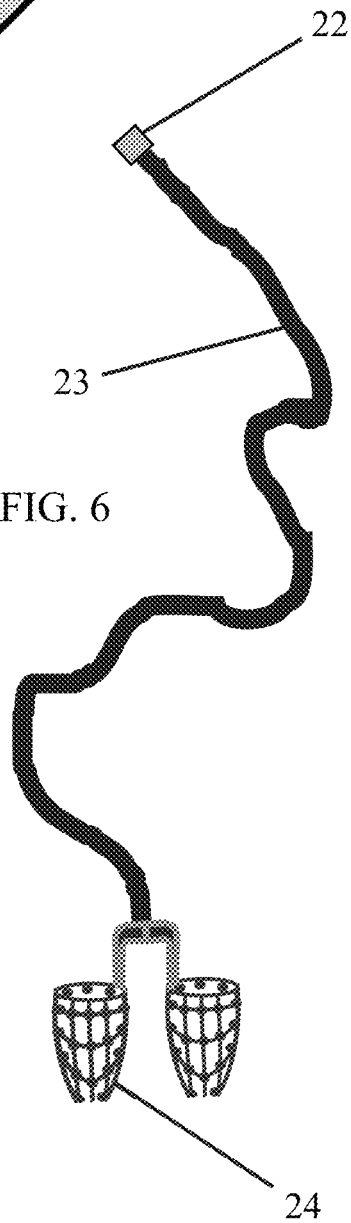

FIG. 6 is an illustration of the available conduction tube accoutrement for conveying aromatic air to a user's nostrils.

DETAILED DESCRIPTION OF DRAWINGS

Preferred Embodiment

Figure 1A:
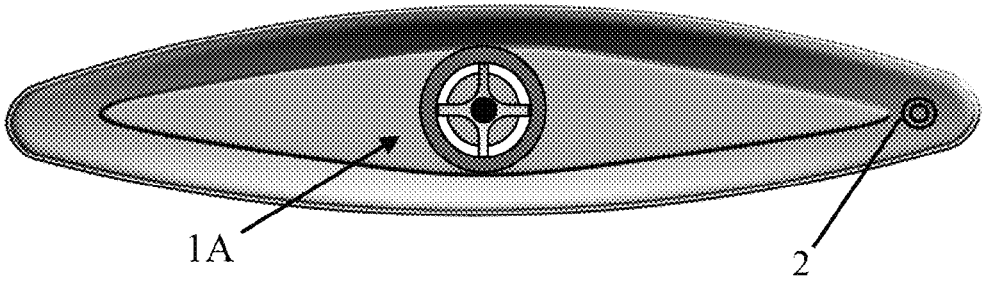
FIG. 1A is the Right Side View in horizontal aspect of the novel pillow.

Referring now to FIG. 1A, it will be seen that this exterior, rigid plastic-like material component at side of the pillow FIG. 3B features a knob turning mechanism that can be wound for initiation of an effusion process using the Windup/Setting Control knob 1A. The Nostril Attachment/Effusion Management Gauge 2 controls the volume of air entering conduction tube 23 of FIG. 6.

Figure 1B:
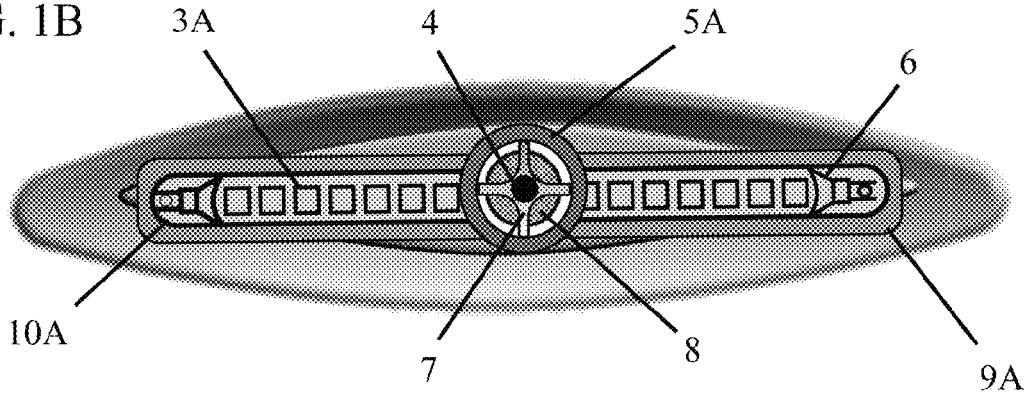
FIG. 1B is the Exterior Facade and Control Panel as seen in FIG. 1A further showing Windup/Setting Control Knob and interior controlling mechanisms for controlled effusion and diffusion processes.

Referring now to FIG. 1B, the Exterior Facade and Control Panel as seen in FIG. 1A further showing Windup/setting control knob FIG. 2A-7 and interior controlling mechanisms for controlled effusion and diffusion processes. FIG. 1A-2 is the Attachment/Effusion Management Gauge. This illustration further shows a Calibrated Ratchet Mechanism Device 3A for effectuating the Timing Calibration for compressing the air and controlling its release as it works in conjunction with Windup/Setting Control Knob 7. Windup Timer and Pressure Setting Actuator 5A contains the calibration and means for a tension mechanism to compress a spring-like mechanism for the purpose of compressing the air and controlling its release. Treated Exchangeable Permeable Porous Medium FIG. 2A-8 transfuses aromatic scents from a Compression Chamber Facility 10A. An Effused Air Transference Receptacle 9A delivers pressurized aromatic scents to the Diffusion Conduit Ports 15 and 18 of FIG. 3A. A Pillow/Nasal Conduction Activation Button FIG. 2A-4 switches between effusion conduction to pillow and conduction to Pillow/Nasal Conduction tube FIG. 6-23. Paired Compression Devices, funnel compression cones 6, and 19 pps. 2 & 3, are utilized at both ends of Compression Chamber Facility FIG. 1B-10A for the purpose of causing emission of compressed air to effuse through a Flow Containment Receptacle FIG. 2A-11 to the Treated Exchangeable Permeable Porous Medium 8 which itself is suffused with an aromatic oil substance for consequent effusion throughout the novel pillow. Such flow containment receptacle allows ingress of aromatic air to flow into one direction.

Referring now to FIG. 2A, a windup/setting control module for the pillow is seen, showing a Pillow/Nasal Conduction Activation Button 4 which, when executed, switches the conduction of the aromatic air to either the pillow or to the nasal conduction tube 23 of FIG. 6. The Windup Timer and Pressure Setting Actuator 5A consists of the necessary structures for initiating air pressure. It works in conjunction with Compression Chamber Facility 10A of FIG. 1B for the process of effusing and diffusing aromatic air throughout the pillow. The process is initiated by the mechanical winding of the Windup/Setting Control Knob FIG. 2A-7 which may be turned clockwise to provide tension to the Compression Chamber Facility 10A facility. It can be optionally set for up to Two hours using the Windup/Setting Control Knob 7. As it works conjointly with Calibrated Ratchet Mechanism Device 3A and Interior of Calibrated Ratchet Mechanism Device 3B of FIG. 3A, 5A is the essential component for effusion of aromatic air through the Treated Exchangeable Permeable Porous Medium 8 for subsequent diffusion of the aromatic scents throughout the pillow interior.

The Treated Exchangeable Permeable Porous Medium FIG. 2A-8 is used for containing and effusing aromatic air as gotten from added extracts of Essential Oils. A flow containment receptacle 11 is the facility for holding the Treated Exchangeable Permeable Porous Medium while the compressed air enters the compartment area to permeate such medium to be effused and diffused throughout the novel pillow. Such effused air would thus become scented by the added plant extract oil as gotten from commercial essential oils or other types of scented fluids then channeled through an Emission Tributary Funnel 14, Emission Tributary Head 12, and Emission Tributary Aperture 13. The Emission Tributary Head 12 delivers effused aromatic air into Transference Receptacle 9A of FIG. 1B through the Emission Tributary Aperture 13.

FIGS. 1A and 1B show two aspects of the controlling components for infusion and diffusion of aromatic air. Thes depictions of the pillow illustrate at least a plastic material which is durable sufficiently enough to safely encase the inner machinery of the compression and effusion devices. This shielding element overlaps only to the extent that it harbors, and provides rigid protection for the moving parts and connections of the interior compression and effusion devices. However, the rigid portion of such shielding element is designed in such manner that it would not interfere with the comfort of its user. It encompasses the essential oils porous medium, a windup/timer pressure actuator, and a Windup/Setting Control Knob FIG. 1B-7. The pillow width depiction reveals a ratcheting mechanism which would be used for facilitating tension in order to accomplish pressurization. Also on this page is the indication that the Pillow/Nasal Conduction activation button is at the center of the Windup/Timer and Control Knob FIG. 1A. This button would be pushed for activation of the alternative said Pillow/Nasal Conduction Activation button or pillow options of the user.

Referring now to FIG. 3A. This illustration shows CAD drawings of novel pillow showing interior mechanisms and relevant devices for the objective processes for effusion and diffusion of aromatic air throughout the novel pillow. They clearly teach how a Diffusion Conduction Port 15 carries aromatic scents evenly throughout interior of pillow. It receives diffused aromatic air that is channeled through Air Transference Tube Facility 9B and further into an Emission Tributary Head 12 which delivers effused aromatic air into Primary Conduction Tube 15 which conducts it to a Secondary Conduction Tube 18, itself conveying the aromatic air to Diffusion Distribution Outlet 16 for measured release of aromatic air into the environment of pillow. Arrow at 17 simply shows path of diffused aromatic air current. To facilitate compression of air in the Compression Tube 10B, Funnel Compression Cones 6 and 19 on both sides of the flow containment receptacle, are forced together causing compressed air into the Replaceable Porous Effusion Pad 8. A more detailed depiction of the Compression Tube is seen in 10A. Air being effused from within Air Transference Facility depicted here in 9B is used for delivering aromatic scents to the Diffusion conduction Ports 15 and 18 which carry aromatic scents evenly throughout interior of pillow.

This Air Transference Facility 9B is more clearly depicted in 9A in depiction below herein. Interior of Calibrated Ratchet Mechanism Device 3B, minimally shown here in part, works with Windup Timer and Pressure Setting Actuator 5A to provide sustained tension pressure force for causing aromatic air to flow through to Transference and Diffusion Conduits and Diffusion Distribution Outlet 15, 18, and 16 for the objective effusion of this aromatic air to flow through the interior structures of illustrative pillow as shown here in FIG. 3A and through the fabric of conventional pillow as shown in FIG. 3B to the terminal environment of a user of this novel pillow apparatus. The Calibrated Ratchet mechanism interior aspect 3B can be more clearly shown by 3A in depiction below.

On this page, the Flow Containment Receptacle 11 serves as a barrier mechanism against escaping air. Once a porous medium has been inserted into it and the unit is snapped back into place, the air, once pressurized, effuses through the unit and the porous medium in a singular direction to the transference facility 9A. A treated exchangeable permeable porous medium 8 will be used as a component of the apparatus that temporarily contains the aromatic scents.

Upper illustration is the interior of the Aromatic Air Effusion Pillow. It shows, at the right end of the diagram, the compression and effusion elements as component devices for compression of air through a permeable porous effusion medium to which has been supplied a measured amount of a consumer's desired aromatic scent. Spanning across the interior of the pillow is the Diffusion Conduction Ports 15 and 18. Such ports carry the aromatic air from the effusion section of the pillow to the Diffusion Distribution Outlets. The components for the compression and effusion mechanisms are further indicated below by illustration, referenced letters, numbers, and relevant graphic details. The Pillow/Nasal Conduction conduit FIG. 6 is for the alternative transference of aromatic air direct to the user's nostrils as opposed to transpiration through the pillow as initiated at control button located at center of control knob 4. It is also detachable at the connection point 2.

Turning now to FIG. 4, Modular Pressurization and Effusion Management Apparatus, it can be seen that it is the same device in top view as the cross-sectional view shown in illustration FIG. 2A. The illustration FIG. 4 shows repeated depictions of the compression and aromatic air transference process structure. The Compression Chamber Facility 10A outline is more plainly seen here showing how the Funnel Compression Cones 6 and 19 operate to generate compressed air and how such air would flow through 9 the Air Transference Facility. Current of aromatic air 17 here and in FIG. 3A indicates the direction of flow through Diffusion conduction Ports 15 and 18 which carry aromatic scents evenly throughout interior of the novel pillow after being distributed by Compressed Air Introduction Aperture 13.

FIG. 2B illustrates an alternative aspect view of FIG. 2A. As such, it incorporates the interior mechanisms as shown herein with 8, 11, 5B, 5C, 5D, and 7. At the top of this module is the Pillow/Nasal Conduction Activation Button 4 which is a selector switch for a user to alternate between conduction of aromatic air for direct conduction to the nostrils of a user or for conduction to go through the pillow. The Windup Knob 7 entails the initiation of the process of having the aromatic air to flow. Upon being wound to a desired setting, the unwinding process also causes a compression mechanism to pressurize the air causing it to flow through the pillow apparatus and to the environment of a user. Several Clockwise turns may be used to set air release component. A desired time-released setting can be made suitable to a user. The setting of time and duration of the flow throughout the pillow is accomplished by the coordination of the winding of this knob 7 likely in the clockwise direction indicated 20 along with the catch mechanism indicated by elements 5B, 5C, and 5D along with previously-mentioned Calibrated Ratchet Mechanism Device 3A and 3B of FIG. 3A. 5D represents a spring-like means for obtaining tension in the process of both winding and unwinding in coordination with both the windup mechanism 7 and the Calibrated Ratchet Mechanism Device 3A and 3B of FIG. 3A. 5B and 5C are catch and movement-control mechanisms. The winding mechanisms coordinated through the operation among these items mentioned entail the impetus necessary for the active flow dynamics of the aromatic air throughout the pillow as described. The scent carried by the air is accomplished by the pressurization of the air through the flow containment receptacle 11 which holds the Treated Exchangeable Permeable Porous Medium 8. This medium holds the user-applied scented oil or other aromatic substance. Its material composition may be of a gauze-like substance which would allow permeation of ingressed air. The channeling of the flow of scents through the pillow entails the coordination among the conduction facilities as noted herein 9A, 9B, 10A, 10B, 16, 17, and 18 of FIG. 3A.

On this page, the illustration at left is a clearer view of the compression and effusion units into which are seen in the control mechanisms. The Essential Oils Insertion Medium, treated exchangeable permeable porous medium, 8 constitutes the main element of the apparatus. It is replaceable and interchangeable subject to a user's options for the aromatherapy "experience" he or she would like. Such interchangeable medium would be as plentiful as there are numbers of scents available. According to aromatherapy theory, emotions, moods, even snoring can be modified for improvement. This novel product aims to facilitate this need.

FIG. 3B is a CAD perspective view rendering of a conventional pillow showing the novel control panel exterior façade and Windup/Setting Control Module as seen and fore-stated in FIG. 1A and further shows a Windup/Setting Control Knob FIG. 2A-7 and interior controlling mechanisms for controlled effusion and diffusion processes.

The Nasal Clip Apparatus FIG. 5 shows how the effused aromatic air from the pillow would enter the Nostril Insertion Applicators. First entering at 25 as an internal flow, its course would take it along the path to mix with external air 26 so as to insure that mixture is not too concentrated thus exiting at 27 as a balanced mixture of both internal aromatic air and external air from the surrounding environment. The point indicated at 21 represent apertures for terminal release of internal aromatic air from pillow.

FIG. 6 is the optional Pillow/Nasal Conduction Tube for conveying aromatic effused air from pillow to the nostrils of a user. An Attachment device 22 is for connecting Conduction Tube 23 to the novel pillow by using its receptor 2 of FIG. 3B. The Nostril Insertion Applicators, the singular of a pair shown here, 24 provide optional direct flow of aromatic air to a user when he or she may be travelling by plane, bus, etc. and does not want to have the aromatic air to affect a nearby traveler. In such case, the user would be using a smaller, travel, pillow design. The user would attach the optional but available device 23 to its receptor 2 of pillow FIG. 3B, engage the alternator button 4 of FIG. 2B for pillow application then, if needed, adjust modulator. It is the Effusion Management Gauge FIG. 3B-2 controls the volume of air entering Conduction Tube FIG. 6-23.

This page provides a larger view of the Pillow/Nasal Conduction Tube that conducts effused aromatic air directly to a user's nostrils. The device clips lightly onto the nasal septum. The insertion units, one of two, FIG. 6-24 are adjustable, allowing an ample balance of effused, scented air, through the tube and the environmental air. This effused air is semi-passive thus allowing for a balanced blend of air between it and non-effused environmental air FIG. 5-26. also shown is a perspective view of the novel pillow showing the essential control component.

Operation

The product introduced herein is a utility which employs a means for the effusing, diffusing, and transpiring of aromatic air through a pillow to a user for his or her satisfaction of use.

This product, Aromatic Air Effusion Pillow, is operated by a user's simply placing a synthetic or natural plant oil-additive to a gauze-type pad into a component of the pillow, turning a time-set device at one side of the pillow to the desired time-expiration limit, as measured in minutes and hours, then resting his/her head on the pillow as he or she retires for bed or for any desired period of relaxation. The transpiration of an aromatic fragrance will effuse air and the effusion of the user's selected choice of scents that he/she would apply to the essential oils porous medium, Replaceable Porous Effusion Medium Pg. 2 No. 8 or that, otherwise, would be a pre-selected essential oils porous medium intact, prepackaged from a manufacturer; such porous medium allows air currents to permeate (effuse) through it to the diffusion component for dispersion throughout the pillow then ultimately to the transpiration process from the pillow itself to the user. However, another component of the aromatic air conduction system is that of the Pillow/Nasal Conduction Tube alternative conduction method from the effusion medium which discretely conducts the aromatic air for nasal inhalation of the user.

CONCLUSION

Ramifications and Scope of Invention

It can be seen from the foregoing that the novel invention presents a non-traditional manner of obtaining aromatherapy treatment while using a conventional pillow. The product, no doubt, brings a tremendous commercial opportunity for those involved in the aromatherapy market; as well, the marketing prospects for the typical pillow may be enhanced to a great degree. The health concerns and expectations of people involved in aromatherapy theory and research will find the product a novelty that would add to the interest in the field for both the well being of those who use the products, and commercial benefit for those involved in the marketing of such products.

What is claimed is:

1. An aromatic air effusion apparatus for a pillow, comprising:

a modular pressurization and effusion management apparatus which is set into a rigid substratum panel which itself is fixed into at least one edge of said pillow, said modular pressurization and effusion management apparatus being a means for pressurizing an ingression of air then effusing it through a treated exchangeable permeable porous medium, which is disposed in a flow containment receptacle subsequently channeling said ingression of air through conductive media for purposes of diffusing said aromatic air for means of transpiration throughout the pillow and, alternatively, effusing it through to a user-selected conduit which is exterior to said pillow as an ancillary component option for nasal passage conduction, which is exclusive to said conduit.

2. The aromatic air effusion apparatus for a pillow of claim 1 wherein said modular pressurization and effusion management apparatus comprises a windup/setting control module, containing at least:

a. a windup and setting actuator control knob which is turned in a specified manner to provide tension for purpose of providing torque;

b. a PNC pillow/nasal conduction activation button for nasal conduction which when manually pressed by a user activates a pre-wound at least spiral ribbon spring mechanism which is a power source means for controlled time release, said button further activates, by subsequent depression, an alternative channeling of said compressed air between a primary conduction tube for the pillow and an air transference tube facility thus alternatively opening and closing air conduction between the pillow and an air transference tube whose compression itself is necessary for the aromatic air conduction to a plurality of nostril insertion applicators, which entail said user optionally selecting to switch from pillow conduction use at times when ambient effusion of said aromatic air, as coming from said pillow, may not be discreet for exclusive use as would be likely preferred when using a travel-size design of said pillow when conduction may be selectively switched using said PNC activation button;

c. a compression chamber facility which works with said windup and setting actuator control knob for a process of effusing and transpiring aromatic air throughout the pillow;

d. said flow containment receptacle wherein said exchangeable permeable porous medium is disposed;

e. an emission tributary head which delivers effused aromatic air into an air transference receptacle;

f. at least one emission tributary aperture which delivers aromatic air to the air transference receptacle prior to delivery to the primary conduction tube and a secondary conduction tube then to a plurality of diffusion distribution outlets disposed in the pillow; and g. an emission tributary funnel which receives the aromatic air from said compression chamber facility then channels it to the emission tributary head and to the effused air transference receptacle.

3. The aromatic air effusion apparatus for a pillow of claim 1 wherein said rigid substratum panel is an exterior façade and windup/control module at an edge of the pillow.

4. The aromatic air effusion apparatus for a pillow of claim 1 wherein said treated exchangeable permeable porous medium is infused with at least an essential oil of any one of a multiplicity of naturally occurring species of plant extracts preferred by the user, said oil may further be either synthetic as well as natural.

5. The aromatic air effusion apparatus for a pillow of claim 1 wherein said treated exchangeable permeable porous medium comprises at least a permeable porous pad which comports with predetermined dimensions of said flow containment receptacle within which it is disposed for the process of aeration, said medium is further predisposed for occasional replacement contingent upon a preferred option of said user for any one of a multiplicity of alternative species of natural plant oil extracts.

6. The aromatic air effusion apparatus for a pillow of claim 2 wherein said conductive media comprise involvement of said primary conduction tube, said secondary tube, and said diffusion distribution outlets as functionally contiguous to said modular pressurization and effusion management apparatus; the conductive media carries the aromatic air, the modular pressurization and effusion management apparatus produces and delivers it, said modular pressurization and effusion management apparatus further being adaptable for means of manufacture of conventional pillows of various sizes, shapes, and designs which require various structural configurations of said conductive media and said substratum panel, and further wherein said conductive media entail an involvement of interior cushioning and exterior fabric whose synthesis are predetermined for the optimum process for transpiration of said aromatic air from said pillow.

7. The aromatic air effusion apparatus for a pillow of claim 2 wherein said modular pressurization and effusion management apparatus, further comprising:

a. said air transference receptacle which receives pressurized said aromatic air from said emission tributary funnel then delivers it to both the primary conduction tube and the secondary conduction tube;

b. said primary conduction tube which receives pressurized said aromatic air from said air transference receptacle then conducts it to said secondary conduction tube;

c. said secondary conduction tube which receives pressurized said aromatic air from said primary conduction tube then conducts it to said diffusion distribution outlets;

d. said diffusion distribution outlets which allow for measured release of pressurized said aromatic air into the environment of said pillow;

e. at least the primary conduction tube, the secondary conduction tube, and the diffusion distribution outlets which comprise an interconnecting apparatus for the purpose of distributing the aromatic air throughout the pillow;

f. said PNC activation button which is used for transference of pressurized said aromatic air direct to the user's nasal passage as the alternative to said effusion through the pillow; and g. funnel compression cones which operate conjointly to compress air into said flow containment receptacle wherein would be disposed said treated exchangeable permeable porous medium.

8. The aromatic air effusion apparatus for a pillow of claim 1 wherein said aromatic air is the resultant composition of the process of said pressurizing of said ingression of air then effusing it through said treated exchangeable permeable porous medium disposed in said flow containment receptacle, said permeable porous medium being manually infused by the user of said pillow with arbitrary amounts of at least said essential oil of any one of a multiplicity of scents preferred by the user of either synthetic as well as naturally occurring plant extracts.

9. A method of using a pillow, comprising:

a. opening a windup/setting access module of said pillow;

b. inserting a treated exchangeable permeable porous medium into a flow containment receptacle unit within which said medium would be effused with an ingression of compressed air, said medium is infused with a user-preferred selection of any one of a multiplicity of available at least synthetic as well as naturally occurring oil essences of plant extracts;

c. winding a timing/setting knob in a predetermined manner to a desired time setting of a torque-power release mechanism means for causing an aeration scent of any one of said multiplicity of available at least synthetic as well as naturally occurring oil essences of plant extracts;

d. once pressing a pillow and nasal activation button for the purpose of having the pre-set release mechanism to engage for steady effusion of said desired scent to transpire throughout the pillow, a second depression of said button will engage an ancillary nostril conduction component thus shutting of conduction to the pillow and redirecting it for the desired nasal inspiration selection channel as chosen by said user;

e. said user reclining and resting his or her head on the pillow as he or she retires for a night of sleep in bed or for any desired reclining period of relaxation;

f. inspiring and enjoying the effusion of scent of any one of a multiplicity of available said at least synthetic as well as naturally occurring oil essences of plant extracts preferred by the user; and g. said windup/setting access module discontinuing its wind down process at completion of pre-set time span set by said user;

whereby inspiration of said aromatic scents would emotionally enhance the personal well-being of the user of the pillow apparatus instilling in him or her a desired scent-specific elated mood, or desired condition, of metabolism as are health-enhancing objectives presumed by believers and practitioners in the efficacy and the art of aromatherapy and essential oils health benefits theory.

* * * * *